United States Patent [19]

Tesch

[11] 4,123,979

[45] Nov. 7, 1978

[54] INCINERATOR

[76] Inventor: Allen Tesch, Lake Amy Belle, Hubertus, Wis. 53033

[21] Appl. No.: 805,628

[22] Filed: Jun. 13, 1977

[51] Int. Cl.[2] ..... F23G 5/08

[52] U.S. Cl. ..... 110/212; 110/214; 110/254; 110/255

[58] Field of Search ..... 110/8 R, 8 A; 23/277 C

[56] References Cited

U.S. PATENT DOCUMENTS

| | | | |
|---|---|---|---|
| 3,645,218 | 2/1972 | Davis | 110/8 A |
| 3,745,942 | 7/1973 | Thompson et al. | 110/8 A |
| 3,799,075 | 3/1974 | Hazzard et al. | 110/8 A |
| 3,875,874 | 4/1975 | Altmann | 110/8 A |

*Primary Examiner*—Kenneth W. Sprague

*Attorney, Agent, or Firm*—Willis B. Swartwout, III

[57] ABSTRACT

The present invention comprises an improved after burner for a multi-chamber incinerator including a pair of successive gas flow tubes having arcuate surfaces disposed one over the other such that the said one is an arcuate surface having a radius to a longitudinal centerline axis which is oriented in the same vertical plane but offset above the longitudinal centerline axis of the said other of said arcuate surfaces, baffles for directing gas flow including such flow from the first of said tubes to the second of said tubes, ports for ingesting air into said tubes at an angle to the path of gas flow through the tubes and super oxygenating the tubes and burners in the tubes to totally consume combustible pollutants carried by the gas flow.

6 Claims, 3 Drawing Figures

INCINERATOR

In the past, incinerators have been unsatisfactory in both single and multi-stage construction because combustible materials were not totally consumed and the combustible pollutants contained in the exhaust gases were discharged into the atmosphere thereby polluting the atmosphere. The cause for this involved two factors; the first was that exhaust gases flowed through the after burner or exhaust conduits too rapidly for the after burners therein contained to completely consume pollutants therein contained, the second was that the heat intensity in the after burners of exhaust tubes was insufficient to completely consume pollutant particles contained within the exhaust gases even when the gas flow rate was slowed by a tortuous gas flow path with baffles and expanding gas flow chambers.

The present invention proposes to overcome the problems of the prior art not only by directing, expanding, turbulating, and treating gas flow through the secondary or after burner to slow the rate of flow substantially to help insure total combustion of the pollutants therein contained before discharge to atmosphere, but also by uniquely constructing a pair of tapered successive horizontal gas flow tubes, flowing in opposite directions, to have such tubes with arcuate surfaces for focusing radiated heat from said tubes along the longitudinal centerline axis of both tubes and the innermost of said tubes relative to the arcuate surfaces in the after burner chamber.

It is, therefore, an object of the present invention to provide an after burner chamber for a multiple chamber incinerator having at least a pair of horizontal gas flow tubes, having arcuate surfaces disposed one over the other such that the said one is an arcuate surface having a radius to a longitudinal centerline axis which is oriented in the same vertical plane as the longitudinal centerline axis of the said other of said arcuate surfaces but offset above the centerline axis of the other of said arcuate surfaces, one within the other, baffling said gas flow to change the direction thereof and slow down in rate of flow.

It is another object of the present invention to provide in an incinerator of the character described means for ingesting air under pressure into said tubes at an angle of approximately 90° to the direction of gas flow to spin and turbulate said gas flow and super oxygenate said tubes to further slow the rate of gas flow therethrough and secure more complete combustion of combustible pollutants contained in said gas flow.

It is still another object of the present invention to provide in an incinerator of the character described means in the path of gas flow from the first of said pair of tubes to the second of said pair of tubes to direct and turn said gas flow path 180° thereby slowing the rate of flow of said gases by creating an impendence to said flow.

It is yet another object of the present invention to provide in an incinerator of the character described a cyclonic feeder and separator means for conveying material to be incinerated to the primary combustion chamber and supplying air under pressure to said tubes for spinning said gas flow and super oxygenating said tubes as previously set forth herein.

It is a further object of the present invention to provide in an incinerator of the character above described means between said cyclonic feeder and separator and said tubes for preheating said air under pressure.

Figure 2:
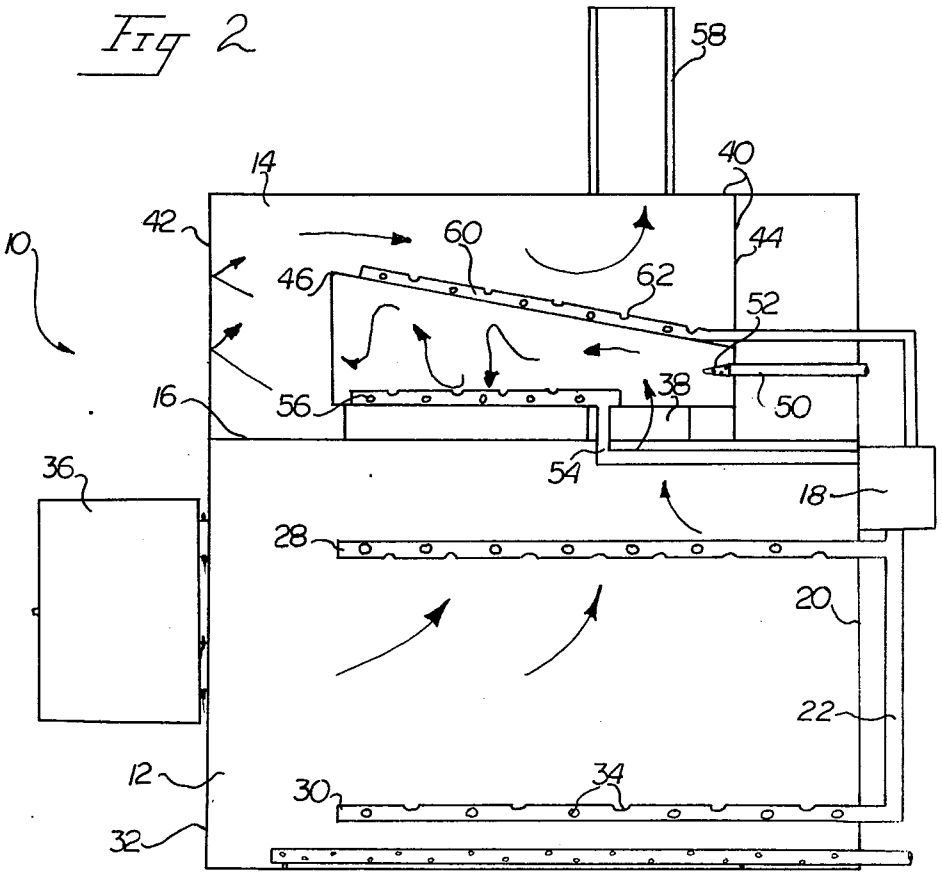
FIG. 2 is a vertical cross-section through a side elevational view of the structure shown in FIG. 1.
Figure 1:
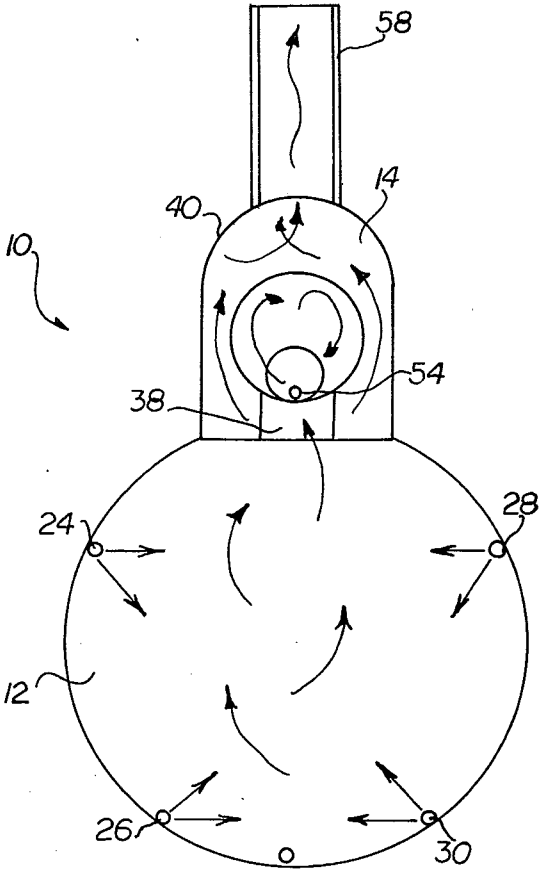
FIG. 1 is a vertical cross-section through a front elevational view of an incinerator embodying the structure of the present invention.

Referring to the drawings and more particularly to FIGS. 1 and 2 thereof, a multiple chamber incinerator is shown generally identified by the numeral 10. Incinerator 10 could have any number of chambers depending upon the need but for purposes of this disclosure incinerator 10 includes a primary combustion chamber 12 and a secondary combustion chamber or after burner 14. After burner 14 is disposed immediately above chamber 12 and has a common wall 16 with chamber 12.

In vertical cross-section as shown in FIG. 1, chamber 12 is generally circular. A blower 18 is mounted to the exterior surface of rear wall 20 of chamber 12. A first blower discharge conduit 22 is coupled at one end to blower 18 and has one end each of four air discharge conduits 24, 26, 28, and 30 coupled thereto. Conduits 24, 26, 28, and 30 extend in spaced parallel relationship through rear wall 20 into the interior of chamber 12 terminating at points adjacent to front wall 32 of chamber 12. Conduits 24, 26, 28, and 30 are provided with ports 34 for directing the air flow within chamber 12, Front wall 32 of chamber 12 is provided with a hinge mounted door 36 for covering an opening in wall 32 through which material to be incinerated may be introduce into chamber 12 for burning. Common wall 16 is provided with an aperture 38 connecting chamber 12 and after burner 14.

Exhaust gases containing combustible pollutants result from the combustion taking place in chamber 12. These gases rise according to the laws of physics and pass through aperture 38 into burner 14.

Burner 14 includes an elongated exterior wall 40 generally in the inverted U-shaped form in vertical cross-section as viewed in FIG. 1 with the lowermost margins of wall 40 joined to the uppersurface of wall 16 as viewed in FIGS. 1 and 2 of the drawings. Burner 14 has a front end closure wall 42 and a rear end closure wall 44 both generally in the inverted U-shape in vertical plan, and joined in closing engagement with the end margins of wall 40 and wall 16 forming an elongated second after burner burning chamber having an arcuate upper wall portion, said arcuate upper wall portion being the arc of a cylinder whose radii join on a longitudinal centerline relative to said cylindrical chamber. Wall 40 is formed from a metal or material such that the inner arcuate surface of said upper wall portion is heat reflective.

Disposed within the elongated second burning chamber formed by wall 40, front and rear end closure walls 42 and 44, and common wall 16 is a truncated oblique circular conoidal tube 46 open at either end. The smaller end of tube 46 is joined in any suitable manner (not shown) to rear wall 44, forming a first after-burner burning chamber open at one end. Tube 46 is oriented such that it extends from rear wall 44 toward front wall 42. Tube 46 is the type of oblique circular conoidal shape wherein, if the cone were not truncated, the fixed point for the cone lies in the same horizontal plane as one point on the plane curve or circle forming the base of such cone and perpendicular to the plane of such circular base at that point. The inner surface of the tube 46 is heat reflective as previously described relative to wall 40. Tube 46 is further provided with an aperture 48 complementary to aperture 38 previously described for the ingress of the exhaust gases from chamber 12 containing combustible pollutants. A fuel supply pipe 50 having a burner orifice 52 at one end extends through wall 44 such that orifice 52 is within the smaller end of tube 46. The pipe 50 extends to a source of fuel of any suitable varitey (not shown).

A second blower discharge conduit 54 is coupled at one end to blower 18 and extends through wall 20 and 16 into tube 46 and along the bottom of tube 46 as viewed in FIGS. 1 and 2. As the gases from chamber 12 enter tube 46, gas from orifice 52 and the flame thereof impinges upon the flow from chamber 12, and turns the flow in a horizontal direction along tube 46. That portion of conduit 54 which lies within tube 46 is provided with a series of ports 56 which port air under pressure into tube 46 perpendicular to the direction of flow of gases from chamber 12 causing the said flow of gases to spin within tube 46 and super oxygenating tube 46 in support of combustion therein. Since tube 46 gets larger as it extends towards wall 42 the gasses in tube 46 will expand and the rate of flow will decline.

As the horizontal flow of gasses leaves tube 46, it impinges upon wall 42 which acts as a baffle to direct the flow around and over tube 46 reversing the direction of flow 180° to the opposite horizontal direction. The balance of the gas flow is created by this arrangement which together with the change of direction of the flow slows the rate of flow.

An exhaust stack 58 is coupled at one end to the curved upper surface of wall 40 adjacent wall 44 and is open to atmosphere at its opposite end. The placement of tube 46 within the area defined by tube 46, wall 40, walls 42 and 44, and common wall 16 defines an exhaust chamber which increases in volume as the flow of gases approaches wall 44 such that gases following the laws of physics will expand further slowing their rate of flow.

A third blower discharge conduit 60 is coupled at one end to blower 18 and extends through walls 20 and 44 and lies along the upper surface as viewed in FIG. 2 of tube 46 extending almost the entire length of tube 46. The portion of conduit 60 lying along tube 46 is provided with a series of ports 62 which port air under pressure into the chamber defined by tube 46, wall 40, walls 42, and 44, and common wall 16 perpendicular to the direction of flow of gases therethrough to spin the gases thereby slowing their rate of flow.

While no gas tube or burner orifice is shown in the chamber defined by tube 46, wall 40, walls 42 and 44, and common wall 16, it should be understood that if additional combustion were desired in said chamber such structure could be provided.

Figure 3:
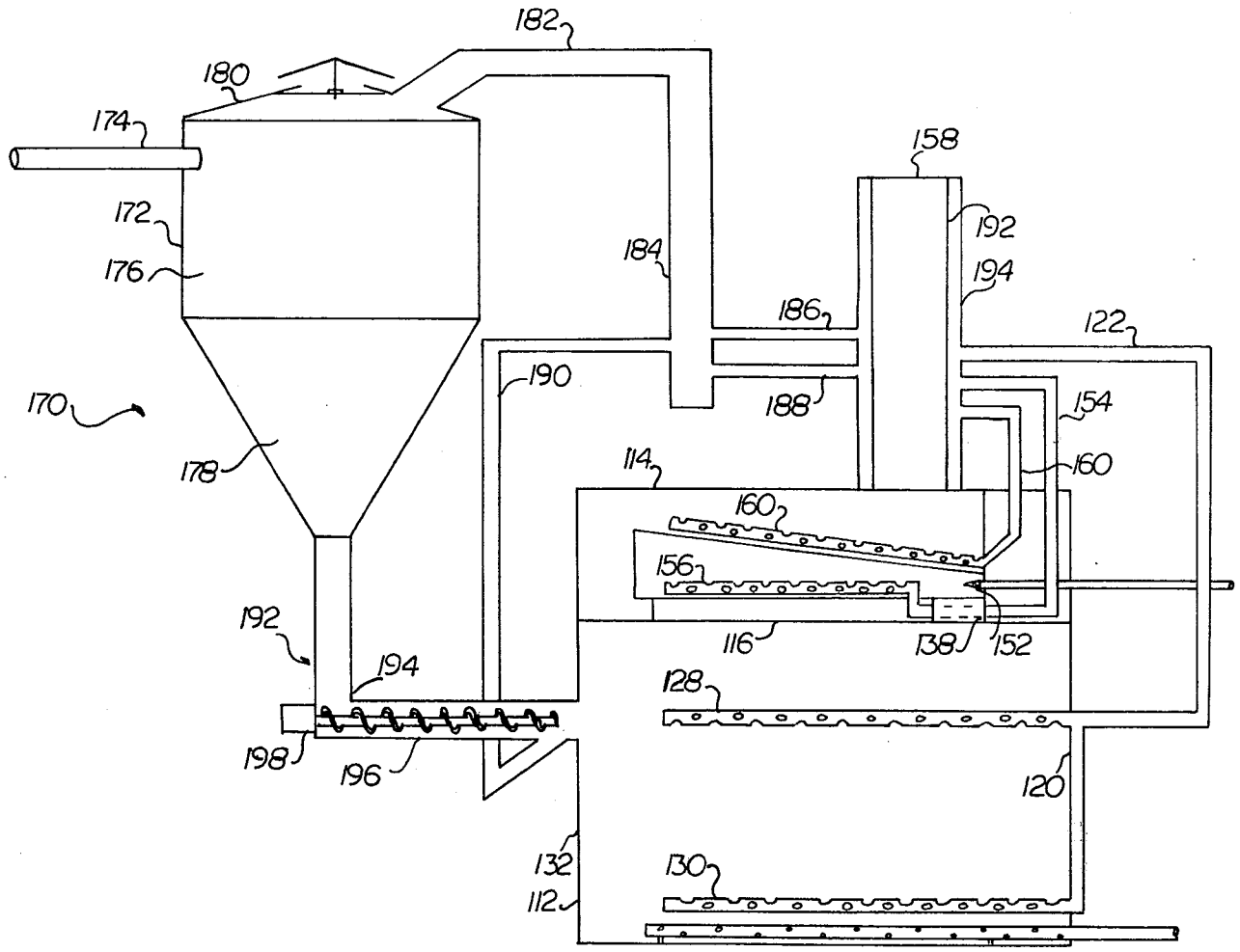
FIG. 3 is a vertical cross-section through a side elevational view of structure embodying a second concept of the present invention.

Referring now to FIG. 3 of the drawings, a second embodiment of the present invention is disclosed wherein similar structure is designated by similar numbers in the one hundred series. In this second embodiment 110 a cyclonic feeder and separator unit generally identified by the numeral 170 replaces a blower 18. Feeder and separator 170 includes an elongated vertical separating tank 172 which contains a blower (not shown).

A material intake conduit 174 is coupled at one end to the uppermost portion of tank 172 and the end remote from tank 172 (not shown) extends to a bin or storage means of some standard type for material to be incinerated. It can be seen from this description that material to be incinerated and air are drawn into tank 172. Tank 172 includes an upper hollow cylindrical section 176 and a lower truncated cone section 178. A cylinder closure cover 180 closes off the uppermost end of section 176 and is provided with a vent 180. One end of an air exhaust conduit 182 is coupled to cover 180 and extends therefrom terminating in a pipe closure 184. Three air conductor conduits 186, 188, and 190 are coupled at one end of each to exhaust conduit 182.

Stack 158 includes an inner stack 192 and an outer stack 194. Inner and outer stacks 192 and 194 are coaxial and in spaced parallel relationship. The respective ends of conductor conduits 186 and 188 remote from air exhaust conduit 182 and coupled to stack 194.

The lower most portion of section 178 is joined to leg 192 of an L shaped material feed conduit 194. Conduit 194 also has a foot section 196. Foot section 196 is joined to front wall 132 in material feeding engagement with chamber 112. The end of air conductor conduit 190 remote from exhaust conduit 182 is joined with the bottom of foot section 196 as viewed in FIG. 3 at a location immediately adjacent the junction of foot section 196 with front wall 132. An electrically driven worm gear feeder 198 is installed in foot section 196 and is coaxial therewith extending the entire length of section 196. Conduits 122, 154 and 160 are for identical purposes as their conterparts in the first embodiment but are coupled to outer stack 194 in fluid conducting engagement instead of directly to a blower.

It may now be seen that as air and material are drawn through conduit 174 into tank 172 the shape of tank 172 will direct the flow into a cyclonic flow pattern in section 176 and ultimately a helical cyclonic pattern in section 178. Gravity will ultimately cause the material to drop down through tank 172 into conduit 194 where it will be fed by feeder 198 to the entrance of chamber 112 at the end of foot 196. Air drawn into tank 172 may be drawn out through conduit 182 and also vented to atmosphere vent 180. Some of the air drawn out through conduit 182 will pass into conduit 190 and will pick up the material at the end of foot 196 and blow it into chamber 112. Air in conduit 182 will also pass through conductor conduits 186 and 188 into the space between inner stack 192 and outer stack 194 where it will be preheated before passing through conduits 122, 154, and 160 into incinerator chambers 112 and 114.

It is a result of the unique construction of applicants invention that has been previously described herein that the longitudinal centerline of the arcuate surface of wall 40 lies in the same vertical plane but spaced above the longitudinal centerline of the arcuate surface of tube 46. The benefit obtained from this construction is that heat in the second chamber is reflected by the inner surface of wall 40 through the gases being consumed in chamber 14 to the outer surface of tube 46 in narrowing pie shaped arc segments and tube 46 is similarly reflecting its heat from the inner surface of tube 46 to the centerline axis thereby multiplying and increasing the heat to support combustion in the tube 46. This construction has proved so effective that an incinerator of this construction may be charged with 100% plastic waste from a cold start (no preheating) without emitting smoke, odor or flyash and therefore should be substantially in conformity with state and federal anti-pollution standards for clean air.

I claim:

1. In a multi-chamber incinerator an after burner including at least one horizontally disposed exhaust gas flow tube whose cross-sectional dimention includes an arcuate portion throughout the length thereof and a second horizontally disposed gas flow tube defined within said one gas flow tube whose cross-sectional dimension includes an arcuate portion throughout the length thereof, said tubes being interconnected for progressive gas flow, said arcuate portions of said one and said second tubes having radii of different longitudinal center lines in the same vertical plane and in converging horizontal planes in the direction of gas flow, all of the centerline axis of said second tube and substantially all of the centerline axis of said one tube disposed within said second tube whereby gases flowing through said tubes are superheated by said arcuate cross-sectional dimension of said second of said tubes having arc segments smaller than arc segments of the arcuate portion of the cross-sectional dimension of said one of the said tubes concentrating heat by the process of radiation along the longitudinal centerline of the arc of both of said tubes.

2. The invention as set forth in claim 1, wherein said after burner further includes means disposed in the path of gas flow out of the first of said tubes to deflect and direct said gas flow into the second of said tubes.

3. The invention as set forth in claim 1, wherein the volume of said tubes increases in the direction of gas flow and in opposite horizontal directions relative to each other and means are disposed within said second of said tubes for directing a flow of air under pressure throughout the length of said one of said tubes at an angle to the path of gas flow the increasing volume of said tubes expanding and slowing the gases flowing therethrough and said flow of air under pressure super oxygenating the gas within said second of said tubes for total combustion and spinning the gas flow about the longitudinal axis of said tube further slowing the rate of gas flow therethrough to insure total combustion.

4. The invention as set forth in claim 3, wherein said means for directing a flow of air under pressure includes a blower and a blower discharge conduit connected at one end to said blower and extending into said second tube, the portion of said conduit within said second tube being supplied with a plurality of ports for directing a flow of air therethrough perpendicular to the flow path of gases through second tube.

5. The invention as set forth in claim 3, wherein said means for directing a flow of air under pressure includes a cyclonic feeder and separator for supplying material to be incinerated to said incinerator, a blower disposed within said feeder and separator, an elongated air conveying conduit means coupled at one end to said feeder and separator and extending into and through at least one of said one and second tubes, the portion of said conduit means within said tube being provided with a plurality of ports for directing a flow of air under pressure throughout said tube perpendicular to the path of exhaust gas flow therethrough.

6. The invention as set forth in claim 5, wherein said elongated air conveying conduit means includes means for preheating air conveyed therein.

* * * * *